US009697675B2

(12) United States Patent
Solaja

(10) Patent No.: US 9,697,675 B2
(45) Date of Patent: Jul. 4, 2017

(54) GAMING MACHINE HAVING INTERACTIVE VIRTUAL OBJECTS AND METHOD

(71) Applicant: Atlas Gaming Technologies Pty. Ltd., Port Melbourne (AU)

(72) Inventor: Zenja Solaja, Port Melbourne (AU)

(73) Assignee: Atlas Gaming Technologies Pty Ltd. (AU)

( * ) Notice: Subject to any disclaimer, the term of this patent is extended or adjusted under 35 U.S.C. 154(b) by 0 days.

(21) Appl. No.: 14/244,811

(22) Filed: Apr. 3, 2014

(65) Prior Publication Data

US 2015/0018093 A1 Jan. 15, 2015

(30) Foreign Application Priority Data

Apr. 26, 2013 (AU) ..... 2013901462

(51) Int. Cl.
*G07F 17/32* (2006.01)

(52) U.S. Cl.
CPC ..... *G07F 17/3209* (2013.01)

(58) Field of Classification Search
CPC ..... G07F 17/32; G07F 17/3209
USPC ..... 463/31
See application file for complete search history.

(56) References Cited

U.S. PATENT DOCUMENTS

| | | | | |
|---|---|---|---|---|
| 8,581,966 | B2 * | 11/2013 | Chen | G02B 27/0093 348/42 |
| 2004/0002380 | A1 * | 1/2004 | Brosnan et al. | 463/32 |
| 2012/0100911 | A1 * | 4/2012 | Rejen | A63F 13/00 463/31 |
| 2012/0115581 | A1 * | 5/2012 | Englman et al. | 463/25 |
| 2012/0231886 | A1 * | 9/2012 | Gomez et al. | 463/32 |
| 2013/0165205 | A1 * | 6/2013 | Collette et al. | 463/20 |

* cited by examiner

*Primary Examiner* — Omkar Deodhar
*Assistant Examiner* — Shauna-Kay Hall
(74) *Attorney, Agent, or Firm* — Lerner, David, Littenberg, Krumholz & Mentlik, LLP

(57) ABSTRACT

A gaming machine has a touch screen interface, a memory to store predetermined rules, and a processor. The processor may display, on the touch screen interface, a virtual environment, a first virtual object and a second virtual object. The first virtual object and second virtual object may behave according to the predetermined rules within the virtual environment. The processor may also detect, via the touch screen interface, a series of player's touch inputs on the second virtual object to update a property of the second virtual object. The processor may then determine an interaction between the first virtual object and the second virtual object having the updated property, and based on the interaction, the processor may update the first virtual object and/or second virtual object within the virtual environment.

15 Claims, 9 Drawing Sheets

GAMING MACHINE HAVING INTERACTIVE VIRTUAL OBJECTS AND METHOD

CROSS-REFERENCE TO RELATED APPLICATIONS

The present application claims priority from Australian Provisional Patent Application No. 2013901462 filed on 26 Apr. 2013, the content of which is incorporated herein by reference.

TECHNICAL FIELD

Described embodiments relate generally to a gaming machine and to an improvement to a game played on such a gaming machine. More particularly, described embodiments relate to a gaming machine having interacting virtual objects, and a method of gaming on a gaming machine having interacting virtual objects.

BACKGROUND

A gaming machine, in its very basic form, allows a player to place a wager and produces a game play outcome that determines a player winning or losing the wager. The outcome of a random number generator of the gaming machine is primarily presented to the player on the gaming machine display device with appealing graphics and animations.

The player can interact with the gaming machine in a number of ways, for example by pressing mechanical buttons (or switches) or by touching a screen. The gaming machine software will respond to a player's input, such as by generating new graphics, animations and sounds, and alter an internal software state of reflect the new presentation. For instance, a touch screen icon will transition from a depressed representation to a pressed representation, and the software will act on a virtual button press (by invoking an action corresponding to the icon representation).

Gaming machines generally present graphical icons corresponding to virtual buttons on the screen for the player to interact with, where only a single touch action would be processed on either touch down (touch action detected when the screen is touched), touch up (touch action no longer detected, corresponding to the finger no longer touching the screen) or both touch down and touch up.

Gaming machines may also present graphical interpretations of realistic objects, such as a wheel to spin or a lever to pull, in which a touch motion (linear or angular swipe) will advance the software state (such as start a wheel spin or activate a new game segment).

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

In a first aspect, there is provided a gaming machine having interactive virtual objects, the gaming machine comprising:

a touch screen interface;

a memory to store predetermined rules;

a processor to:

display, on the touch screen interface, a virtual environment, a first virtual object and a second virtual object, wherein the first virtual object and second virtual object behave according to the predetermined rules within the virtual environment;

detect, via the touch screen interface, a series of player's touch inputs on the second virtual object to update a property of the second virtual object;

determine an interaction between the first virtual object and the second virtual object having the updated property; and based on the interaction, update the first virtual object and/or second virtual object within the virtual environment.

In an embodiment, the series of player's touch inputs may be to move the second virtual object to interact with the first virtual object within the virtual environment.

In an embodiment, the processor may be further to:

based on the series of player's touch inputs, track changes from an old two dimensional (2D) position to a new 2D position of the touch inputs on the touch screen interface; and determine changes from an old three dimensional (3D) position to a new 3D position of the second virtual object within the virtual environment that correspond to the changes to the 2D position.

In an embodiment, the processor is to update the second virtual object within the virtual environment by displaying its movement from the old 3D position to the new 3D position within the virtual environment according to the predetermined rules.

In an embodiment, the processor may be further to:

detect, via the touch screen interface, an initial touch input to create the second virtual object; and determine an initial 2D position of the initial touch input and an initial 3D position of the second virtual object that corresponds with the initial 2D position.

In an embodiment, the predetermined rules may be real-world physics rules of a physics engine according to which the first virtual object and the second virtual object behave. For example, the rules may relate to motion and interaction of physical objects, such as Newtonian motion, collection detection and collision response. In an embodiment, the processor may be further to update a property of the first virtual object according to the predetermined rules.

In an embodiment, the interaction between the first virtual object and second virtual object may be a virtual collision within the virtual environment. In this case, the outcome may be award of points to the player.

In a second aspect, there is provided a method of gaming on a gaming machine having interactive virtual objects according to the first aspect. The method comprises:

displaying, on a touch screen interface of the gaming machine, a virtual environment, a first virtual object and a second virtual object, wherein the first virtual object and second virtual object behave according to the predetermined rules within the virtual environment;

detecting, via the touch screen interface, a series of player's touch inputs on the second virtual object to update a property of the second virtual object;

determining an interaction between the first virtual object and the second virtual object having the updated property; and based on the interaction, updating the first virtual object and/or second virtual object within the virtual environment.

In a third aspect, there is provided a computer-readable medium storing machine-readable instructions to cause a processor of a gaming machine having interactive virtual objects to:

display, on a touch screen interface of the gaming machine, a virtual environment, a first virtual object and a second virtual object, wherein the first virtual object and second virtual object behave according to the predetermined rules within the virtual environment;

detect, via the touch screen interface, a series of player's touch inputs on the second virtual object to update a property of the second virtual object;

determine an interaction between the first virtual object and the second virtual object having the updated property; and based on the interaction, update the first virtual object and/or second virtual object within the virtual environment.

In one embodiment the computer-readable medium may cause the processor of a gaming machine upon detecting the series of player's touch inputs to effect movement of the second virtual object to interact with the first virtual object within the virtual environment.

In one embodiment the computer-readable medium may cause the processor of a gaming machine to (i) based on the series of player's touch inputs, track changes from an old two dimensional (2D) position to a new 2D position of the touch inputs on the touch screen interface; and (ii) determine changes from an old three dimensional (3D) position to a new 3D position of the second virtual object within the virtual environment that correspond to the changes to the 2D position.

The computer-readable medium may cause the processor of a gaming machine to update the second virtual object within the virtual environment by displaying its movement from the old 3D position to the new 3D position within the virtual environment according to the predetermined rules.

In one embodiment the computer-readable medium may cause the processor of a gaming machine to (i) detect, via the touch screen interface, an initial touch input to create the second virtual object; and (ii) determine an initial 2D position of the initial touch input and an initial 3D position of the second virtual object that corresponds with the initial 2D position.

In one embodiment the computer-readable medium may cause the processor of a gaming machine to update a property of the first virtual object according to the predetermined rules.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

In order that the present invention may be more clearly ascertained, embodiments will now be described, by way of example, with reference to the accompanying drawing, in which.

DESCRIPTION OF EMBODIMENTS

Figure 1:
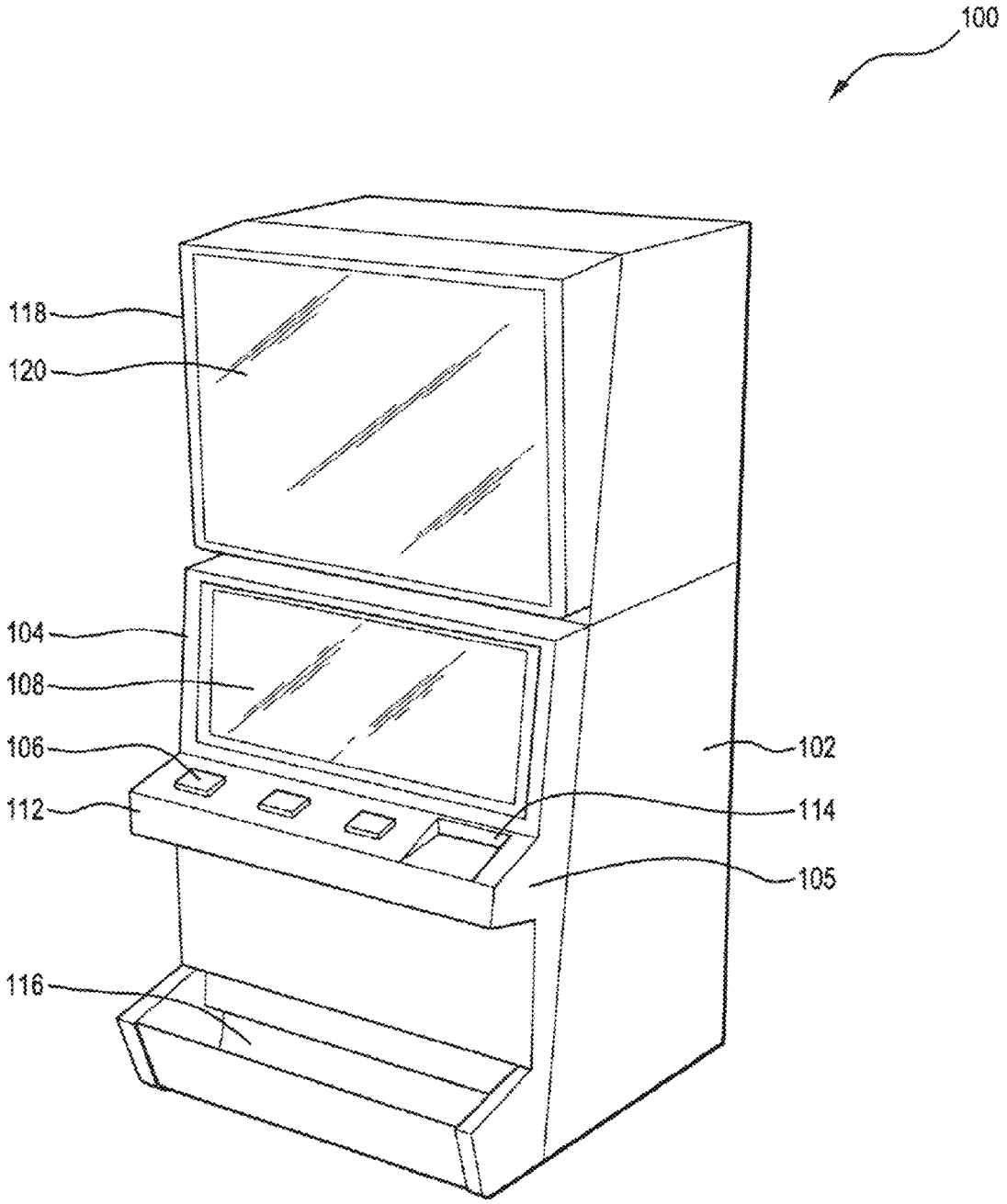
FIG. 1 shows a perspective view of a gaming machine.

Described embodiments generally relate to a gaming machine having interactive virtual objects, and a method of gaming on a gaming machine having interactive virtual objects. The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

One or more of the method steps described in this disclosure may be implemented by executable instructions and parameters 232, 234 (See FIG. 2), stored in the memory 204, 206, 230 (See FIG. 2), that may form software embodiments of the system 100. These instructions 232, 234 that form the system 100 may be executed by the CPU 202 (See FIG. 2) or any other processor. Further, the processor 202, the memory 204, 206, 230, the instructions 232, 234 stored therein, or a combination thereof may serve as a means for performing one or more of the method steps described herein.

Figure 2:
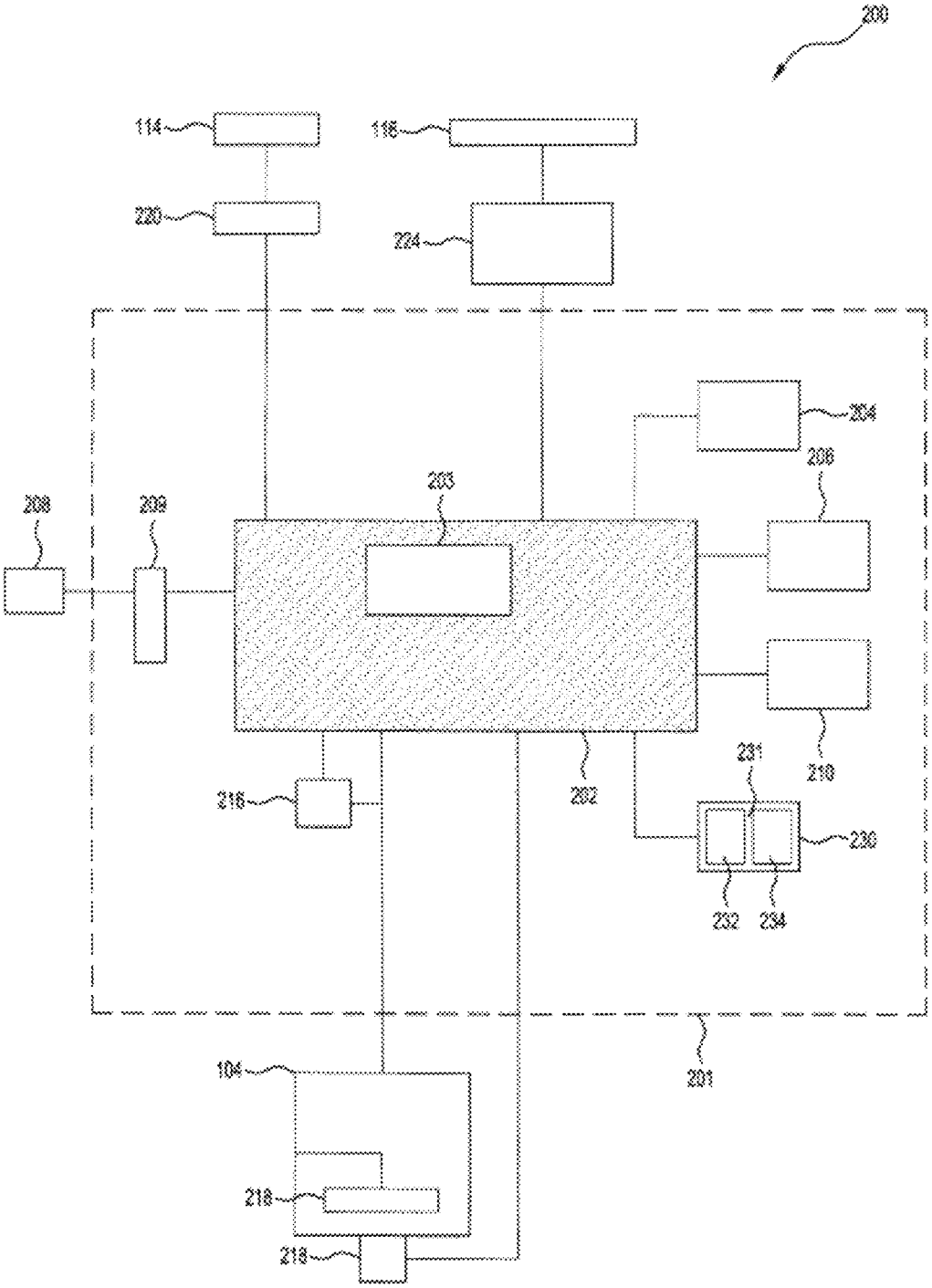
FIG. 2 shows a block diagram of a game logic circuit of the gaming machine illustrated in FIG. 1.

Irrespective of the form, the gaming system 100 has several core components. At the broadest level, the core components are a player interface in the form of a touch screen 108 as illustrated in FIG. 1 and a game controller 200 as illustrated in FIG. 2. The player interface is arranged to enable manual interaction between a player and the gaming system and for this purpose includes the input/output components required for the player to enter instructions and play the game.

Referring now to FIG. 1, reference numeral 100 generally designates a stand-alone gaming system including a game. Hereinafter, the stand-alone gaming system 100 will be referred to as a gaming machine.

The gaming machine 100 includes a console 102 which contains all or most components required to implement a game play whereby a player wins or loses a wager. Access to the components is by way of a hinged door 105. Moulded to the exterior of the console 102 is a display means in the form of at least one visual display unit 104 on which one or more games is played. The video display unit 104 may be implemented as a liquid crystal display, a plasma screen, as a cathode ray screen device or the like. Whilst the console 102 illustrated in FIG. 1 shows a single visual display unit 104, there can be more than one visual display unit on a typical machine. What is displayed on the visual display unit 104 will depend on what the intended goal of the unit is in relation to the player and any other potential participants in the gaming system.

The gaming machine includes a tactile input for a player to interact via touch with the gaming machine 100. In this example, the tactile input is in the form of a combination of pushbuttons 106 and a touch screen 108 for enabling a player to play one or more games. The touch screen is an electronic visual display that can detect the presence and location of a touch within the display area. The touch screen 108 is used during the game play between start of a game and the end of a game. A game is considered to have started once a wager is placed and considered complete once the wager has been lost or won. Certain functions of the pushbutton are: initiation of game play, credit output, gameplay selection, completion of gameplay etc. A midtrim 112 of the machine 100 houses the pushbuttons 106.

The tactile input may optionally or further include a joystick comprising of a stick that pivots on a base and reports its angle or direction to the device it is controlling. The tactile input may optionally or further include a trackpad/touchpad being a pointing device featuring a tactile sensor to translate the motion and position of a user's fingers to a relative position on screen.

It should be appreciated that tactile input may include any suitable device that enables the player to produce an input signal that is received by the processor. Tactile input in the form of pushbuttons 106 and/or regions on touch screen 108 may include a one bet button, a max bet button, or a repeat the bet button. With a one bet button for instance, the player places a bet by pushing the one bet button. The player may increase the bet by one credit each time the player pushes the bet one button.

The midtrim 112 also houses credit input device including a bill collector 114. The credit input device may further include a coin input chute, a card and/or ticket reader, a magnetic reading head for reading a magnetic stripe card, an electronic reader for a proximity card, a near field communications reader or any other form of electronic, wireless or contact that can input credit to the gaming machine.

A credit dispenser in the form of a coin tray 116 is mounted beneath the console 102 and is provided for cash payouts from the machine 100 to the player. A hopper device (not shown) is provided which dispenses coins, or tokens equal to the amount of credit currently on the machine, into the coin tray 116. Aside from the coin tray 116, the credit dispenser may also include a ticket dispenser for issuing a ticket dispensed by a printer which the user can redeem for cash, a note dispenser, a near field communications transmitter or means to enable remote credit transfer. It should be appreciated that any suitable payout mechanisms, such as funding to the player's electronically recordable identification card or smart card, may be implemented in accordance with the gaming machine disclosed herein.

The gaming machine 100 includes a top box 118 on which artwork 120 is carried in the form of electronic visual display units. The artwork 120 could also be made from physical materials such as paper, plastic banners or posters. The artwork 120 may have generic information related to the machine or gaming system or the artwork 120 be specifically made for a particular game to be played on the machine 100. Whilst the artwork 120 is shown as being carried on the top box 118 the art work 120 can also be positioned in or on the bottom panel of the door 105, or any other part of the gaming machine 100 visible to the player.

The gaming machine 100 further includes an auditory unit in the form of speakers (not shown) to provide auditory feedback to the player of the gaming machine 100.

Referring to FIG. 2 of the drawings, game logic circuitry 200 is illustrated. The game logic circuitry 200 includes a gaming controller 201 (otherwise referred to as a logic cage) designated by the dashed lines. As will be appreciated by those skilled in the gaming industry, the logic cage 201 includes a box-like mechanical structure that has slots to guide logic cards into the proper location for electronically plugging into a backplane mounted at the rear of the cage structure. The backplane has connectors for accepting mating connectors on the logic cards. The logic cage and associated cards form one of the basic components of the gaming machine 100 and is securely housed within the cabinet of the gaming machine 100.

Central to the logic cage is a central processing unit 202 such as a processor, a microcontroller-based platform, a suitable integrated circuit, or one or more application-specific integrated circuits (ASIC's). The processor 202 is in communication with or operable to access or to exchange signals with at an outcome evaluator 203, RAM 204, ROM 206, a non-volatile memory in the form of a compact flash 230, an audio output 208 via an audio control module 209, and a random number generator 210. The audio control module 209 has its own digital signal processor, analogue to digital converters, amplifiers and other circuitry necessary to broadcast the output from the speakers. RAM 204 may include non-volatile RAM (NVRAM), magnetic RAM (MRAM), ferroelectric RAM (FeRAM), and other forms as commonly understood in the gaming industry.

Compact flash memory 230 is physically secured within a slot in the logic cage 201. In one embodiment, the compact flash memory 230 is physically secured inside the logic cage within game logic circuitry 200 by a mechanical locking mechanism. Compact flash memory 230 is partitioned 231 into two parts. A first part comprises a game software module 232 and a second part comprises a metering information module 234.

The processor 202 runs executable code residing in game software module 232 of compact flash 230 that facilitates play of the game by a player through the display device and/or push buttons and touch sensors mounted in the screen of the display. Metering information module 234 contains the gaming machine parameters which include values that would usually be stored on a hard meter. The values in metering information module 234 are only ever incremented, and cannot be reset or decremented. The only way to alter the values stored is by running the executable code stored in game software module 232, which is executed by processor 202. The executable code further interacts with the credit dispenser 116 via a payout mechanism 224 and the auditory output 208. The game software module 232 contains the rules of the game, the sequence of gameplay, communicates with external systems, monitors peripheral equipment, maintain integrity of the software code, etc. The processor 202 continually checks for error conditions.

A program which implements the game logic circuitry 200 and the user interface is further run by the central processing unit 202. The processor 202 forms part of a controller 216 that drives the screen of the video display unit 104 and that receives input signals from sensors 218. The sensors 218 include sensors associated with the push buttons and touch sensors mounted in the screen of the video display unit 104. The controller 214 also receives input pulses from mechanisms 220 and 224 to determine whether or not a player has provided sufficient credit from either payment device 114 or payment device 116 to commence playing.

In one embodiment, a player may insert an identification card into a card reader (not shown) of the gaming machine 100. Such an identification card may be a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a mobile phone, a radio frequency identification tag, or any other suitable wireless device, that communicates a player's identification, credit totals (or related data), and other relevant information to the gaming device.

Figure 3:
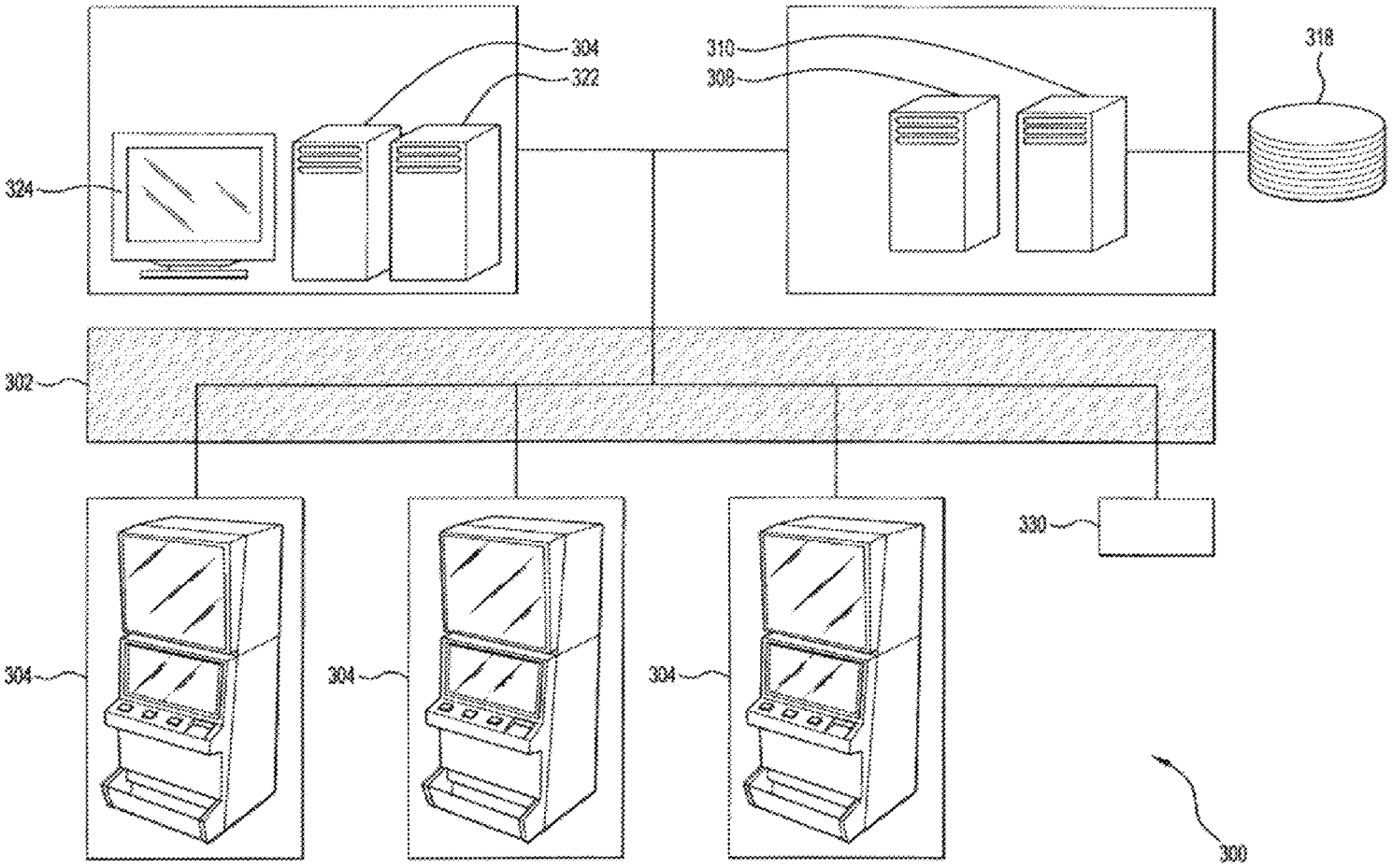
FIG. 3 shows a block diagram of functional components of a gaming system incorporating gaming machines illustrated in FIG. 1.

FIG. 3 shows a gaming system 300 in accordance with an alternative embodiment. The gaming system 300 includes a network 302, which for example may be an Ethernet network. The network 302 may also comprise a wide area network ("WAN"), the plain-old-telephone-system ("POTS"), a local area network ("LAN"), a wireless LAN, the Internet, or any combination of these and other types of networks. Gaming machines 304 are connected to the network 302. The gaming machines 304 provide a player operable interface and may be the same as the gaming machines 100 shown in FIG. 1 or may have simplified functionality depending on the requirements for implementing game play.

In a thick client embodiment, game server 308 implements part of the game played by a player using a gaming machine 304 and the gaming machine 304 implements part of the game. With this embodiment, as both the game server 308 and the gaming device implement part of the game, they collectively provide a game controller. A database management server 310 may manage storage of game programs and associated data for downloading or access by the gaming devices 304 in a database 318.

In a thin client embodiment, game server 308 implements most or all of the game played by a player using a gaming machine 304 and the gaming machine 304 essentially provides only the player interface. With this embodiment, the game server 308 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 300, including for example a gaming floor management server 320, and a licensing server 322 to monitor the use of licenses relating to particular games. An administrator terminal 324 is provided to allow an administrator to run the network 302 and the devices connected to the network.

The gaming system 300 may communicate with other gaming systems, other local networks, for example a corporate network, and/or a wide area network such as the Internet, for example through a firewall 330.

Persons skilled in the art will appreciate that in accordance with known techniques, functionality at the server side of the network may be distributed over a plurality of different computers. For example, elements may be run as a single "engine" on one server or a separate server may be provided. For example, the game server 308 could run a random generator engine. Alternatively, a separate random number generator server could be provided. Further, persons skilled in the art will appreciate that a plurality of game servers could be provided to run different games or a single game server may run a plurality of different games as required by the terminals.

Example gaming machine and method of gaming will now be described with reference to FIG. 4, which shows an example method for providing a virtual environment with interactive virtual objects. According to the example method, the gaming machine is able to detect, via a touch screen interface, a series of player's touch inputs to interact with the virtual environment to cause an interaction between the virtual objects. Such sequential player input cannot be replicated using a single mechanical physical button.

Figure 4:
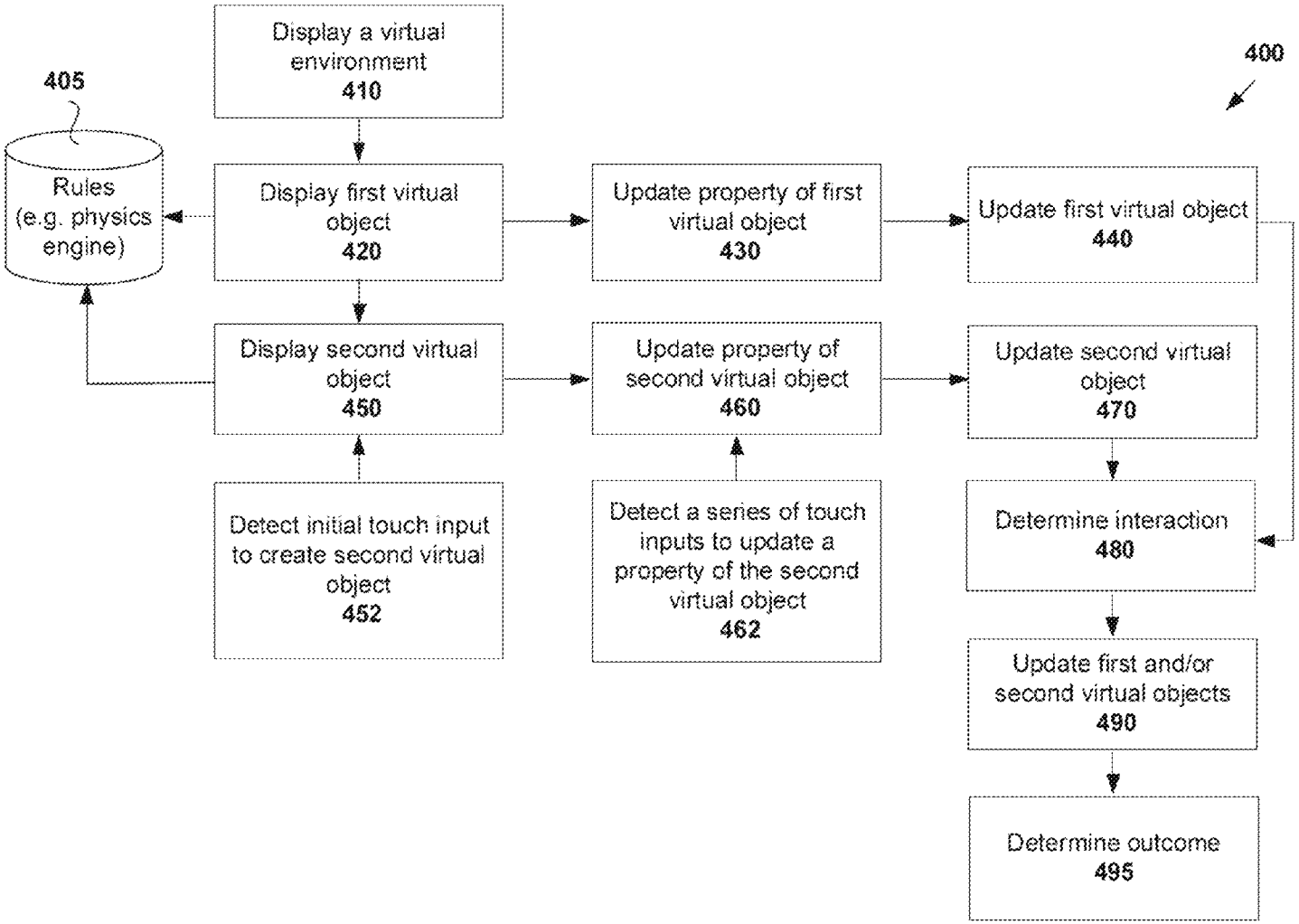
FIG. 4 shows an example method for gaming on a gaming machine with interactive virtual objects.

In a thick client embodiment, the example method in FIG. 4 may be implemented by a processor (e.g. 202 in FIG. 2) of a gaming machine 100. In a thin client embodiment, the example method 400 in FIG. 4 may be implemented by the game server (e.g. 308 in FIG. 3) in conjunction with gaming machine (e.g. 304 in FIG. 3).

Virtual Environment and First Virtual Objects

According to blocks 410 and 420 in FIG. 4, a virtual environment and one or more first virtual objects are created and displayed on a touch screen interface of a gaming machine 100. In the virtual environment, virtual objects (i.e. including the first virtual objects) adhere to or behave according to a set of predetermined rules 405.

The predetermined rules 405 may be real-world based rules stored in a memory device (e.g. physics engine). Here, the "physics engine" is used broadly to include rules, models and calculations relevant to rendering the physical motion and/or interaction of virtual objects. For example, the physics engine 405 may model traditional motion of objects, including applying physical rules related to mass, velocity, acceleration, friction, gravity, and other such physical forces. In further examples, the physics engine 405 may model object properties, such as elasticity and density, and/or physical phenomena related to other mediums, such as viscosity, turbulence, and flow of liquids is modeled. Other physical models include modeling the travel of light and light-related phenomena such as diffraction or diffusion, phase or state change such as melting ice or evaporating water, and modeling the effects of physical events such as explosions.

Figure 5:
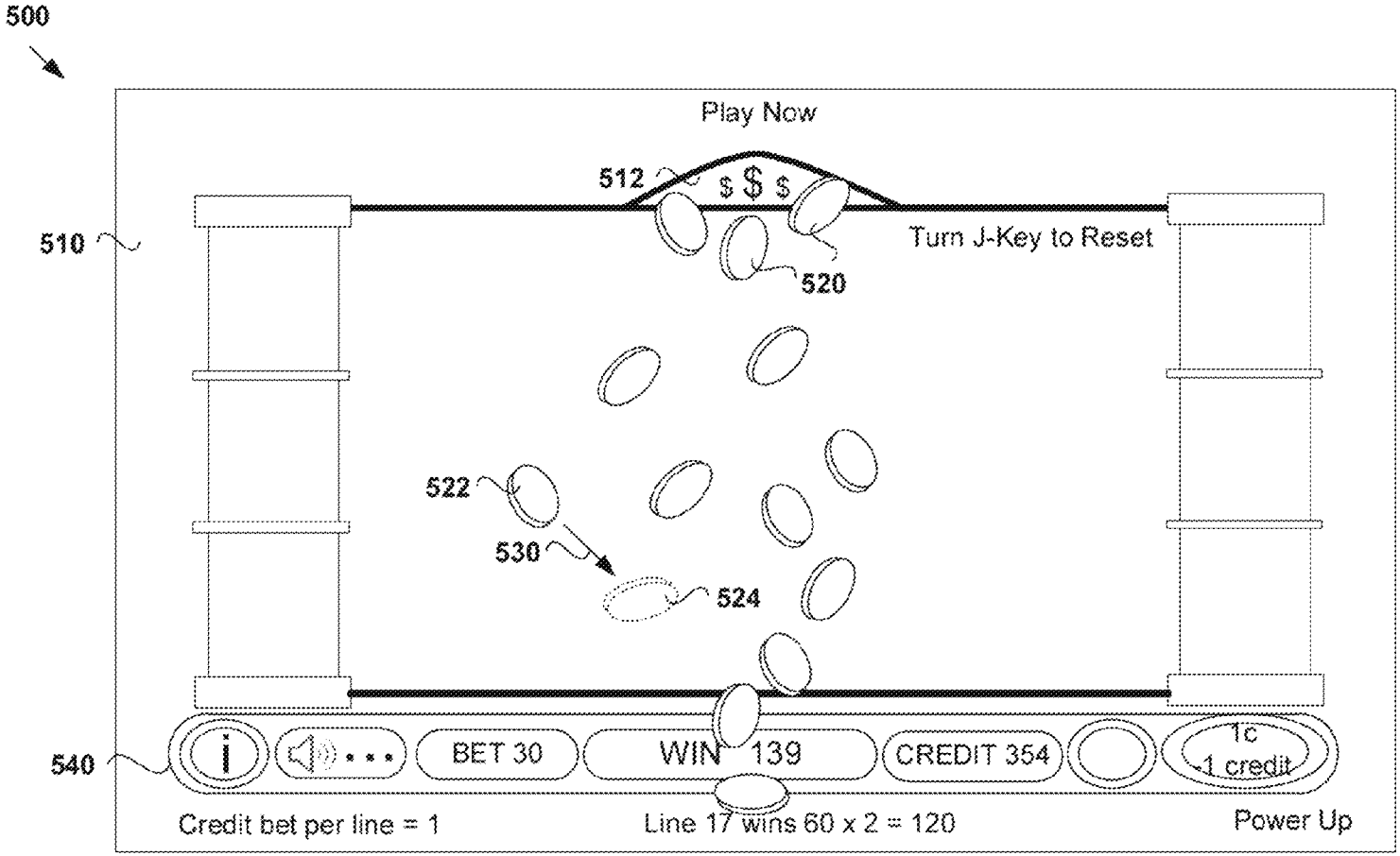
FIG. 5 shows an example screen of the gaming machine in FIG. 1 illustrating a movement of a first virtual object within a virtual environment.

An example virtual environment 510 presented to a player during a "secondary" or "bonus" game is shown in the example screen interface 500 in FIG. 5. The bonus game is generally played in conjunction with a "basic" wagering game, and may be entered upon the occurrence of a selected event of the basic game. Generally, bonus games provide a greater expectation of winning than the basic game and may also be accompanied with more attractive or unusual video displays and/or audio. Bonus games offer tremendous advantages in player appeal and excitement.

In FIG. 5, "first virtual objects" in the form of coins 520 are dispensed from a coin fountain 512 at the top of the screen. The coins 520 have physical properties such as spatial dimensions, mass, position, velocity and inertia etc. The example interface 500 in FIG. 5 also includes a bottom panel 540 that displays various information, such as a help button, a volume adjustment button, number of bets, number of wins, remaining credits, number of credit bet per line, last win etc.

According to blocks 430 and 440 in FIG. 4, properties of the first virtual objects (e.g. coins 520) are updated based on rules in the physics engine 405. For instance, in FIG. 5, coins 520 are launched into the air in the virtual environment 410, and their motion is modelled according to rules in the physics engine 405, such as Newtonian motion, collision detection and collision response. For a particular coin 522, its position within the virtual environment 510 is updated (see 530) to a new position is shown in dotted lines at 524.

Second Virtual Object

A player may interact with the first virtual objects within the virtual environment providing touch inputs via the touch screen 108 on which they are displayed. For instance, in FIG. 5, the player can win bonus points by catching or collecting the coins 520 within the virtual environment 510.

Figure 6:
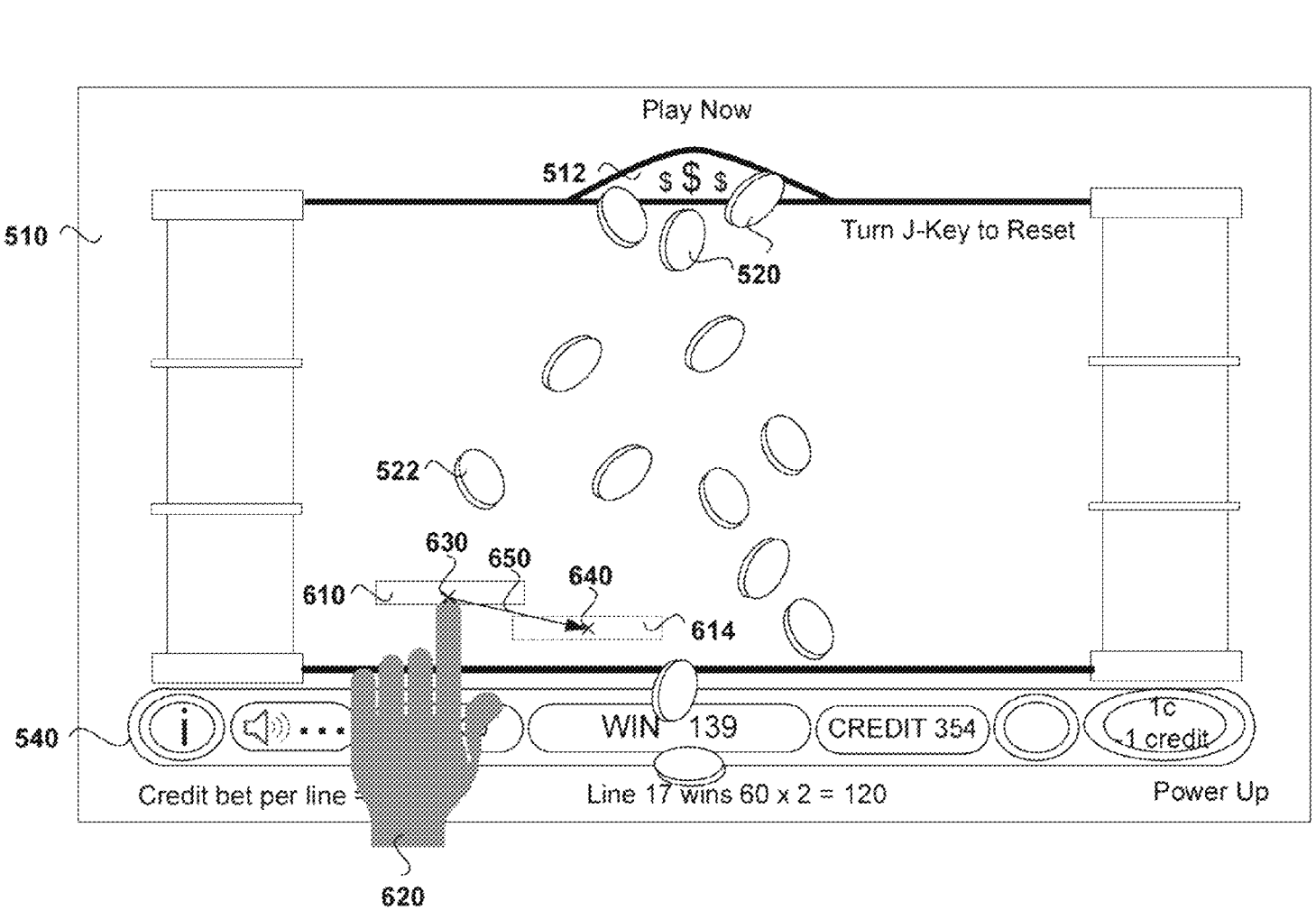
FIG. 6 shows an example screen illustrating a movement of a second virtual object within a virtual environment.

More specifically, according to block 450 in FIG. 4, a second virtual object is also created and displayed within the virtual environment. FIG. 6 shows the example screen 500 in FIG. 5 with a virtual obstacle 610 ("second virtual object"). The second virtual object may be displayed automatically (e.g. after block 420). Alternatively, upon detecting a player's initial touch input on the screen (see block 452 in FIG. 4, and touch input 620), an initial 2D position 630 of the player's touch input is determined or interpreted.

To render the second virtual object in a 3D virtual environment, a 3D position that corresponds to the 2D position is then determined. The 3D position may be a 3D world position calculated using a model, projection and view matrices in a 3D software stack, as well as touch window coordinates. For instance, referring also to FIG. 7, the 2D position is represented as window coordinates ($X_1$, $Y_1$). The corresponding 3D position is represented with two sets of 3D coordinates corresponding to the 2D position. One set of coordinates is at a (a) near plane 710 while the other is at the (b) far plane 720 of the view frustum. Based on the sets of coordinates, a 3D second virtual object is constructed, with its base 722 mapped to the far plane 720 and top 712 mapped to the near plane of the view frustum.

The mapping between 2D position associated with a player's touch input on the screen and the 3D world coordinates of the second virtual object may be determined using any suitable method. One example is the "unproject" function gluUnProject( ) provided by OpenGL (Open Graphics Library), a multi-platform API (application programming interface) for rendering 2D and 3D computer graphics. gluUnProject( ) maps the 2D position to the 3D position based on a modelview matrix, projection matrix and viewport in OpenGL. The modelview matrix is a matrix that stores right, up, back and translation vectors. The projection matrix defines the angle of view, aspect ratio, near and far clipping ranges. The viewport matrix is a 1 by 4 matrix (x, y, width, height) to specify coordinates of lower-left point of the player's screen, and inner width and height of OpenGL window respectively.

Once the second virtual object 610 is presented within the virtual environment 510, a property (e.g. position) of the second virtual obstacle may be updated based on a series of player's touch inputs; see blocks 462, 460 and 470 in FIG. 4. For instance, in FIG. 6, the series of player's touch inputs may include a touch down input to select the second virtual object 610 followed by a drag input to drag the second virtual object 610 on the touch screen interface. The player moves the second virtual object 610 by moving their touch position from an old 2D position 630 to a new 2D position 640 on the screen. The movement 650 may be along any axis of the screen, e.g. left or right (dx/dt), up or down (dy/dt), or a combination thereof.

Changes of 2D touch positions are tracked such that the 3D position of the second virtual object 610 within the virtual environment 510 may be updated. The tracked changes (dx/dt and dy/dt) may be used to calculate the motion of the virtual obstacle 610 to update its position and/or velocity. Based on the new 2D position 640, the corresponding new 3D position is determined using the model shown in FIG. 7. The updated virtual obstacle is shown at a new position 614 in dotted lines in FIG. 6.

Interaction between First and Second Virtual Objects

According to block 480 in FIG. 4, an interaction between the first and second virtual objects is then determined based on their respective properties.

Figure 8:
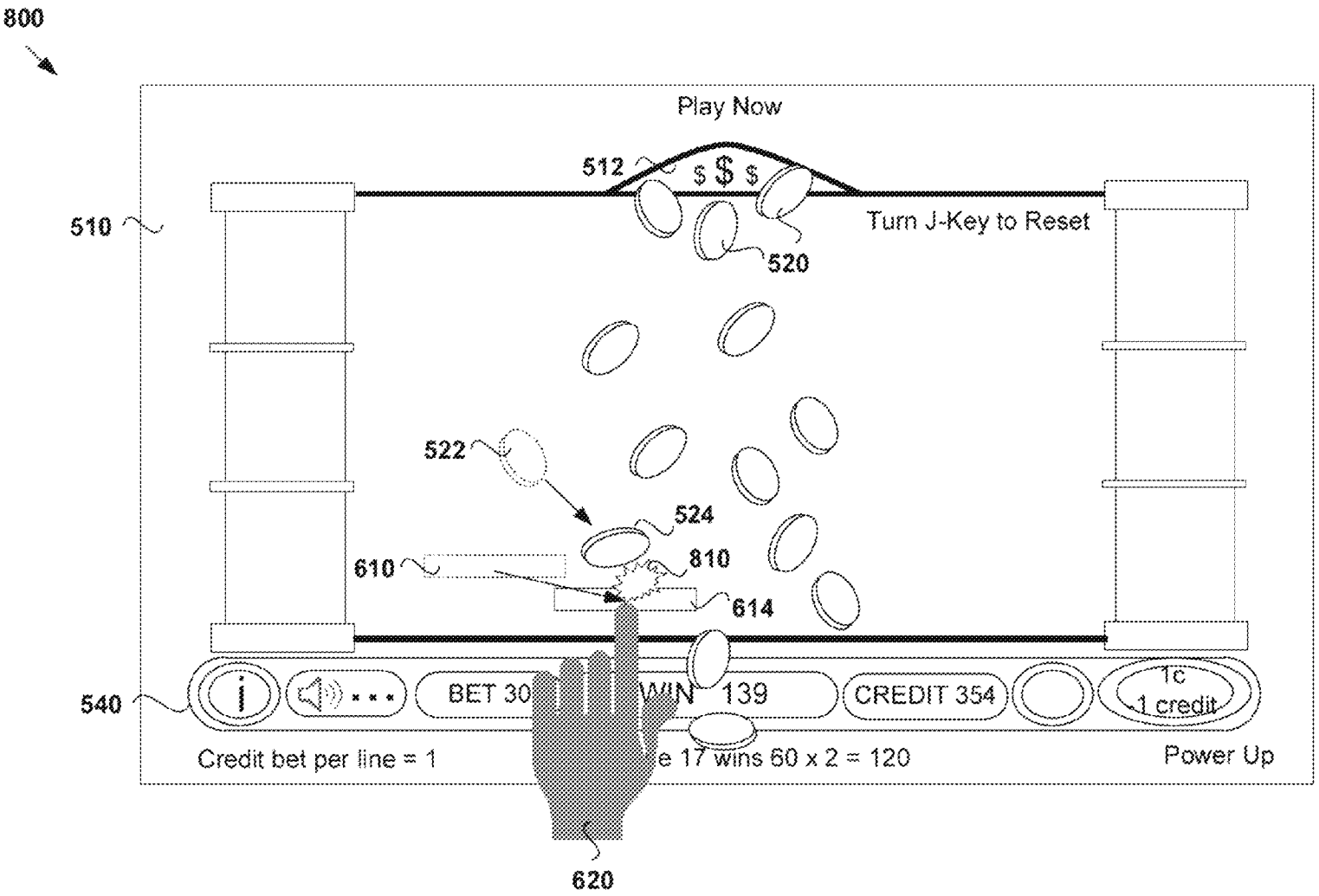
FIG. 8 shows an example screen illustrating an interaction between first and second virtual objects within a virtual environment.

For instance, FIG. 8 shows an example interaction 810 in the form of a collision between the coin 524 in FIG. 5 and the virtual obstacle 614 in FIG. 6 at their respective new positions. Their respectively old positions in FIG. 5 and FIG. 6 are shown on the example screen 800 in dotted lines in FIG. 8 (see 522 and 610 respectively).

Figure 9:
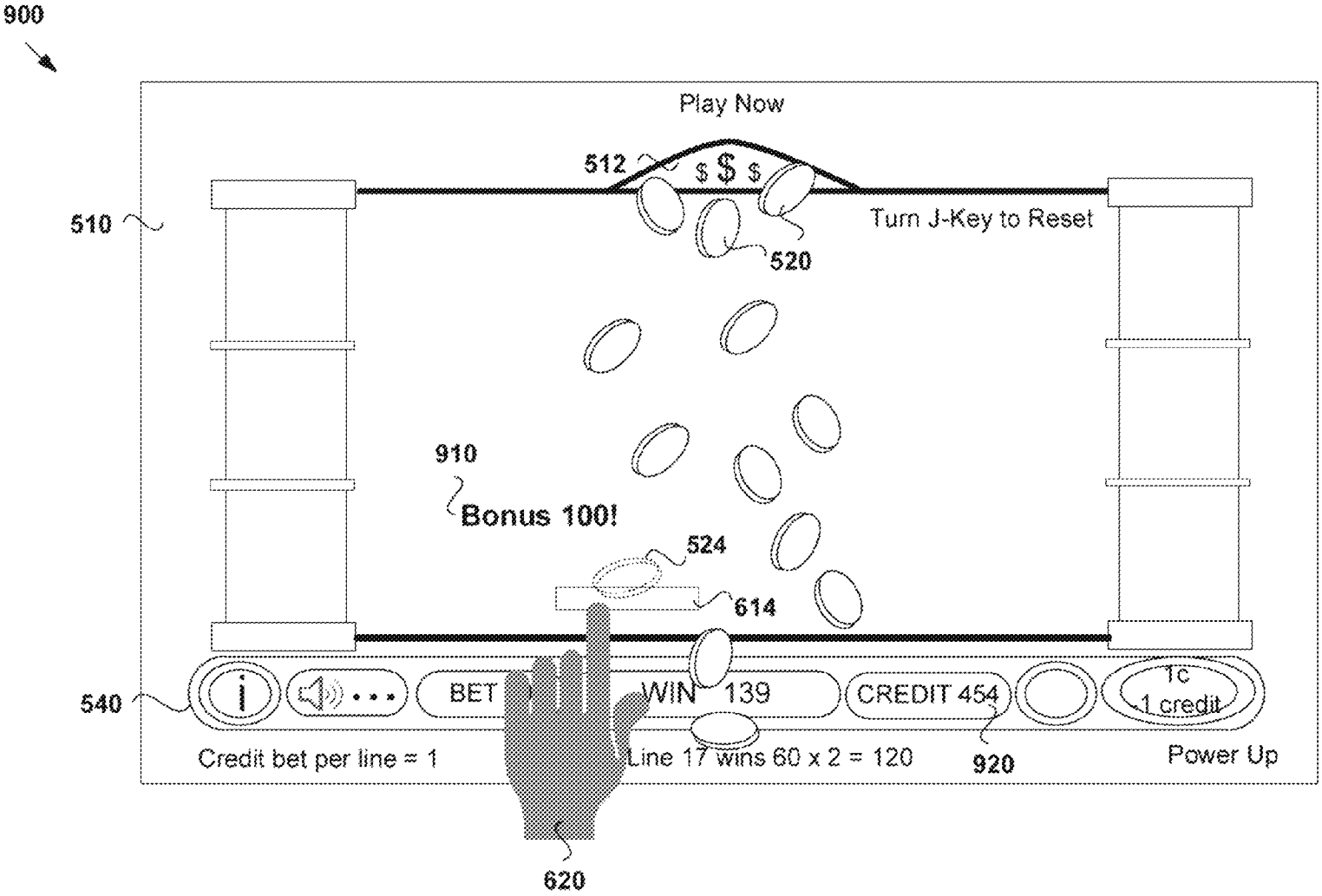
FIG. 9 shows an example screen illustrating an outcome of the interaction in FIG. 8.

The effect of the interaction or collision 810 is shown in FIG. 9. In this case, the coin 524 (shown in dotted lines) disappears from the screen 900 once it has collided with the virtual obstacle 614, which remains on the screen 900. This is to represent the collection of the coin 524 during the bonus round.

Further, according to block 495 in FIG. 4, an outcome or reward associated with the interaction 810 is calculated and used to update the player's credit. For instance, the collision 810 in FIG. 8 represents collection of the coin 524. In FIG. 9, the reward 910 associated with the collection is displayed on the screen (i.e. "Bonus 100") and the player's credit updated from '354' in FIGS. 8 to '454' in FIG. 9 (see 920).

The above process may be repeated until the bonus game ends. For example, the player may continue moving the second virtual object 610 around the screen to collect more coins 520 to increase its reward. At the same time, the coins are updated according to the real-world physics rules to simulate their movement in the physical world within the virtual environment 510.

Although the example method in FIG. 4 has been explained using a coin collection bonus game, it will be appreciated that different implementations of the virtual environment 510, first virtual objects 520 and second virtual object 530 may be used.

For example, more than one first virtual object (e.g. coin 520) may be collected by colliding it with the second virtual object (e.g. virtual obstacle 610). In another example, there may be one first virtual object 520 displayed on the screen, e.g. a ball bouncing against a virtual obstacle and walls displayed on the screen. In a further example, there might be multiple second virtual objects 530 in which case the screen might be a multi-touch screen capable of receiving multi-touch inputs. In a further example, the virtual environment 510 may represent a fish tank in which case objects within the tank may move according to real-world water properties.

Further, the series of touch inputs detected on the touch screen may include any suitable combination of one or more of:

- touch down input when the player's finger is detected to touch the screen;
- touch drag input when the player's finger is detected to move across the screen;
- touch swipe input when the player's finger is detected to touch the screen, move across the screen and then leave the screen;
- touch up input when the player's finger is detected to leave the screen; and
- touch and hold input when the player's finger is detected to touch the screen for a longer period of time, possibly with an increase in the pressure of the point of contact of the finger.

Figure 7:
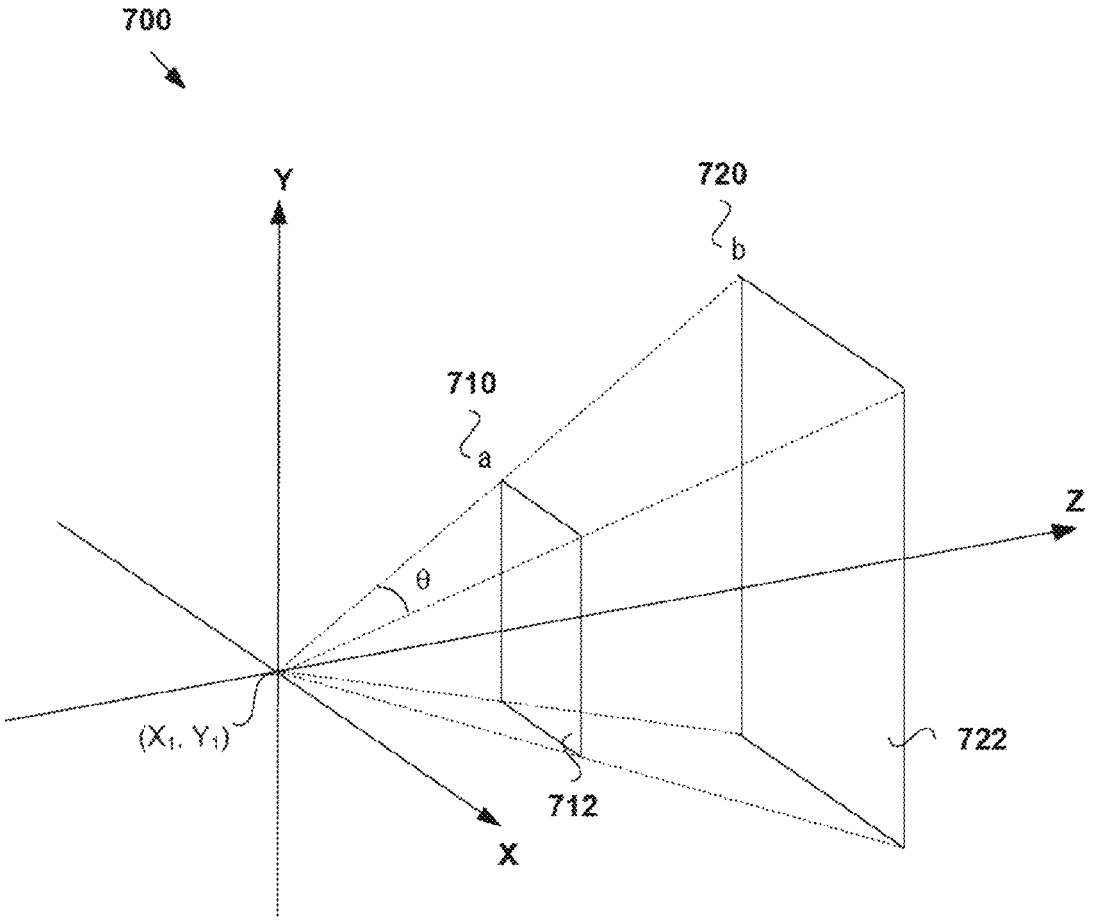
FIG. 7 shows a schematic diagram of a mapping between a 2D position and a 3D position.

Although a box-shaped second virtual object is shown in FIG. 7, it will be appreciated that other shapes may be used, such as a cylinder, sphere, prism, cone or irregular shapes etc. The second virtual object may represent any object suitable for the context of the virtual environment and first virtual objects, e.g. coffee cup, net, coin box, net, ball etc.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

While the foregoing description has been provided by way of example of the preferred embodiments of the present invention as presently contemplated, which utilise gaming machines of the type found in casinos, those skilled in the relevant arts will appreciate that embodiments of the present invention also may have application to internetgaming and/or have application to gaming over a telecommunications network, where mobile handsets are used to display game outcomes and receive player inputs. Such mobile devices include smart phones, notebooks, tablets, iPads and laptop computers. For instance free mobile device games may be offered for download and play on a players personal mobile device as a bonus game play. In such an embodiment the gaming machine may comprise a power interface to enable interaction between the respective devices and/or a communication or wireless interface to enable data transfer. During game play, the gaming machine may be configured to send information to the player's personal mobile device.

Further embodiments may enable a player to upload the outcome of a game or bonus game to a social media site(s), post tournament scores etc.

Certain steps in the processes or process flows described in this disclosure naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another.

A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention.

The invention claimed is:

1. A gaming machine having interactive virtual objects, the gaming machine comprising:

a touch screen interface;

a memory to store predetermined rules;

a credit input device; and a processor configured to:

display, on the touch screen interface in response to receiving input via the credit input device, a virtual environment, a first virtual object and a second virtual object, wherein the first virtual object and second virtual object behave according to the predetermined rules within the virtual environment;

detect, via the touch screen interface, a series of player's touch inputs on the second virtual object to update a property of the second virtual object;

determine an interaction between the first virtual object and the second virtual object having the updated property;

based on the interaction, update the first virtual object and/or second virtual object within the virtual environment;

based on the series of player's touch inputs, track changes from an old two dimensional (2D) position to a new 2D position of the touch inputs on the touch screen interface; and determine changes from an old three dimensional (3D) position to a new 3D position of the second virtual object within the virtual environment that correspond to the changes to the 2D position.

2. A gaming machine according to claim 1, wherein the processor is operable upon detecting the series of player's touch inputs to effect movement of the second virtual object to interact with the first virtual object within the virtual environment.

3. A gaming machine according to claim 1, wherein the processor is further operable to update the second virtual object within the virtual environment by displaying its movement from the old 3D position to the new 3D position within the virtual environment according to the predetermined rules.

4. A gaming machine according to claim 1, wherein the processor is further operable to: (i) detect, via the touch screen interface, an initial touch input to create the second virtual object; and (ii) determine an initial 2D position of the initial touch input and an initial 3D position of the second virtual object that corresponds with the initial 2D position.

5. A gaming machine according to claim 1, wherein the predetermined rules are real-world physics rules of a physics engine according to which the first virtual object and the second virtual object behave.

6. A gaming machine according to claim 5, wherein the predetermined rules relate to motion and interaction of physical objects selected from one of Newtonian motion, collection detection and collision response.

7. A gaming machine according to claim 5, wherein the processor is further operable to update a property of the first virtual object according to the predetermined rules.

8. A gaming machine according to claim 1, wherein the interaction between the first virtual object and second virtual object is a virtual collision within the virtual environment.

9. A gaming machine according to claim 8, wherein the virtual collision within the virtual environment results in an outcome which is an award of points to the player.

10. A method of gaming on a gaming machine having interactive virtual objects and a credit input device, the method comprising:

displaying, on a touch screen interface of the gaming machine and in response to receiving input via the credit input device, a virtual environment, a first virtual object and a second virtual object, wherein the first virtual object and second virtual object behave according to the predetermined rules within the virtual environment;

detecting, via the touch screen interface, a series of player's touch inputs on the second virtual object to update a property of the second virtual object;

determining an interaction between the first virtual object and the second virtual object having the updated property;

based on the interaction, updating the first virtual object and/or second virtual object within the virtual environment;

based on the series of player's touch inputs, tracking changes from an old two dimensional (2D) position to a new 2D position of the touch inputs on the touch screen interface; and determining changes from an old three dimensional (3D) position to a new 3D position of the second virtual object within the virtual environment that correspond to the changes to the 2D position.

11. A non-transitory computer-readable medium storing machine-readable instructions to cause a processor of a gaming machine having interactive virtual objects and a credit input device to:

display, on a touch screen interface of the gaming machine and in response to receiving input via the credit input device, a virtual environment, a first virtual object and a second virtual object, wherein the first virtual object and second virtual object behave according to the predetermined rules within the virtual environment;

detect, via the touch screen interface, a series of player's touch inputs on the second virtual object to update a property of the second virtual object;

determine an interaction between the first virtual object and the second virtual object having the updated property;

based on the interaction, update the first virtual object and/or second virtual object within the virtual environment;

based on the series of player's touch inputs, track changes from an old two dimensional (2D) position to a new 2D position of the touch inputs on the touch screen interface; and determine changes from an old three dimensional (3D) position to a new 3D position of the second virtual object within the virtual environment that correspond to the changes to the 2D position.

12. A non-transitory computer-readable medium according to claim 11, storing machine-readable instructions to cause the processor of a gaming machine upon detecting the series of player's touch inputs to effect movement of the second virtual object to interact with the first virtual object within the virtual environment.

13. A non-transitory computer-readable medium according to claim 11, storing machine-readable instructions to cause the processor of a gaming machine to update the second virtual object within the virtual environment by displaying its movement from the old 3D position to the new 3D position within the virtual environment according to the predetermined rules.

14. A non-transitory computer-readable medium according to claim 11, storing machine-readable instructions to cause the processor of a gaming machine to (i) detect, via the touch screen interface, an initial touch input to create the second virtual object; and (ii) determine an initial 2D position of the initial touch input and an initial 3D position of the second virtual object that corresponds with the initial 2D position.

15. A non-transitory computer-readable medium according to claim 11, storing machine-readable instructions to cause the processor of a gaming machine to update a property of the first virtual object according to the predetermined rules.

* * * * *